United States Patent [19]

Sherrill

[11] Patent Number: 4,531,017

[45] Date of Patent: Jul. 23, 1985

[54] INSULATOR FOR AN ELECTRIC HEATER

[75] Inventor: Jimmy L. Sherrill, Cookeville, Tenn.

[73] Assignee: Tutco, Inc., Cookeville, Tenn.

[21] Appl. No.: 555,019

[22] Filed: Nov. 25, 1983

[51] Int. Cl.[3] ..... H01B 17/56; H05B 3/06

[52] U.S. Cl. ..... 174/138 J; 174/175; 219/532; 219/542; D13/18

[58] Field of Search ..... 174/138 J, 138 G, 146, 174/174, 175; 219/532, 536, 542; 338/296, 299, 304, 305, 321; 336/207; D13/17, 18; 267/61 S

[56] References Cited

U.S. PATENT DOCUMENTS

| | | | |
|---|---|---|---|
| D. 261,260 | 10/1981 | Seeley | D13/18 |
| D. 262,285 | 12/1981 | Janning | D13/18 |
| 2,887,524 | 5/1959 | Fulps | 174/146 X |
| 2,888,546 | 5/1959 | Kinney | 174/146 X |
| 3,336,436 | 8/1967 | Markham | 174/146 |
| 4,363,959 | 12/1982 | Cottrell et al. | 219/532 |
| 4,472,624 | 9/1984 | Janning | 174/138 J X |

*Primary Examiner*—Laramie E. Askin

*Attorney, Agent, or Firm*—Berman, Aisenberg & Platt

[57] ABSTRACT

An insulator for an electric heater employs a central elongated slot and two guide surfaces. Below each guide surface is a notch for receiving an outer convolution of a heater coil, while the central slot terminates in a notch for receiving an intermediate convolution of the heater coil. The slot engages the central convolution of the heater coil before outer convolutions engage the guide surfaces to facilitate installation of the insulator. As the insulator is inserted into the heater coil, the guide surfaces engage the outer convolutions and direct them to respective notches for securely holding the heater coil. The insulator may support a single pass of the heater coil or may be arranged to have these surfaces and notches on opposite ends to support two passes of the heater coil.

7 Claims, 3 Drawing Figures

INSULATOR FOR AN ELECTRIC HEATER

TECHNICAL FIELD

This invention relates to the art of electric heaters, particularly the art of insulating support members for a coiled heater element.

BACKGROUND ART

A known electric heater employs a coiled element attached to a source of electric current. As current is passed through the electric coil, it is heated and radiates energy. Also, the coil may be placed in the flow of air to transfer energy by conduction.

It is common to provide a support structure for holding the coiled heater element, and this structure typically includes a ceramic insulator which engages the heater coil and is attached to the support structure.

U.S. Pat. No. 4,363,959 (Cottrell et al.) shows an electric heater having a coiled heating element. The heating element is supported by insulators which are in turn attached to a frame. Several forms of the insulator are illustrated, and each relies upon a notch engaging an individual convolution of the heater coil. Embodiments shown in FIGS. 3, 4, and 5 employ slanted surfaces to direct adjacent convolutions of the heater coil into respective notches. FIG. 7 shows an embodiment wherein rounded ears direct convolutions into respective notches while another notch receives an intermediate convolution.

U.S. Pat. No. Des. 262,285 (Janning) discloses an insulator having upstanding ears and an intermediate broad notch. The upstanding ears form notches for receiving outer convolutions of a heater coil and an intermediate convolution is received in the central notch between the ears. Since this is a design patent, there is no disclosure regarding the operation of the device; however, it would appear that the rounded ears are intended to separate the convolutions of the heater coil during installation of the insulator.

SUMMARY OF THE INVENTION

Major factors in choosing an insulator are the ability of the insulator to properly support the heater coil and the ease in applying the insulator to the heater coil.

The above-noted prior art insulators fail in one or both of these aspects, and it is an object of the invention to provide an insulator for a heater coil which securely holds the heater coil and is very easy to install.

The insulator according to the invention has a supporting end with a rather long central slot for receiving a central one of three adjacent convolutions of the heater coil. Adjacent the vertical slot are two guide surfaces which are much longer than the guide surfaces of prior art insulators. This structure produces an elongated tip which allows the installer to easily engage the central convolution of the heater coil without necessarily engaging the guide surfaces with the outer convolutions. After the central convolution is securely engaged in the central slot, the insulator is pushed into the coil so that the guide surfaces engage the outer convolutions to thus spread them. Below each guide surface is a notch for receiving a single convolution of the heater coil, and this notch extends inwardly and upwardly from a location below the lower end of each guide surface. As the insulator is pushed into the heater coil, the guide surfaces separate the outer convolutions until they move over the ends of the guide surfaces and into the notches.

During this motion, the central convolution moves down the central slot. When the central convolution engages the bottom of the central slot, it is not possible to push the insulator further into the heater coil, and the outer convolutions then assume their positions in ends of the other two notches because of the resiliency of the heater coil.

In order to support two passes of the heater coil, a similar arrangement is used on the opposite end of the insulator, and the heater coil is applied to this opposite end in the manner described above.

A portion of the insulator also has parallel notches for receiving means to hold the insulating support. In the preferred embodiment, the holding means is a single wire which at least partially encircles the central portion of the insulator and engages the two notches. This wire is then secured to a main frame of the heater element.

It is an object of this invention to provide an insulating support for a coiled heater element which securely holds the heater element and is easy to install.

It is a further object of this invention to provide an insulating support element having an elongated central slot for receiving an intermediate convolution of the heater coil and adjacent notches for receiving outer convolutions of the heater coil wherein the outer convolutions are directed to the outer notches by means of elongated guide surfaces.

DETAILED DESCRIPTION

Figure 1:
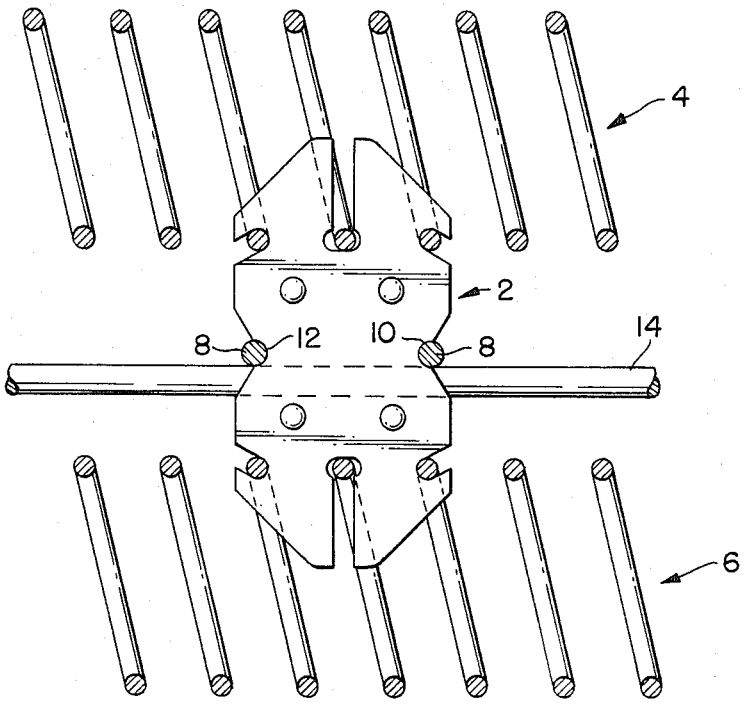
FIG. 1 is a side view of a portion of a heater unit showing the inventive insulator.

In FIG. 1, an insulator 2 is shown in an operative environment supporting a first pass 4 of a heater coil and a second pass 6 of the heater coil. The insulator 2 is held by a wire 8 which at least partially encircles the central portion of the insulator 2 and engages parallel notches 10 and 12. The wire 8 is in turn supported by a frame 14 as is known in the art.

Figure 2:
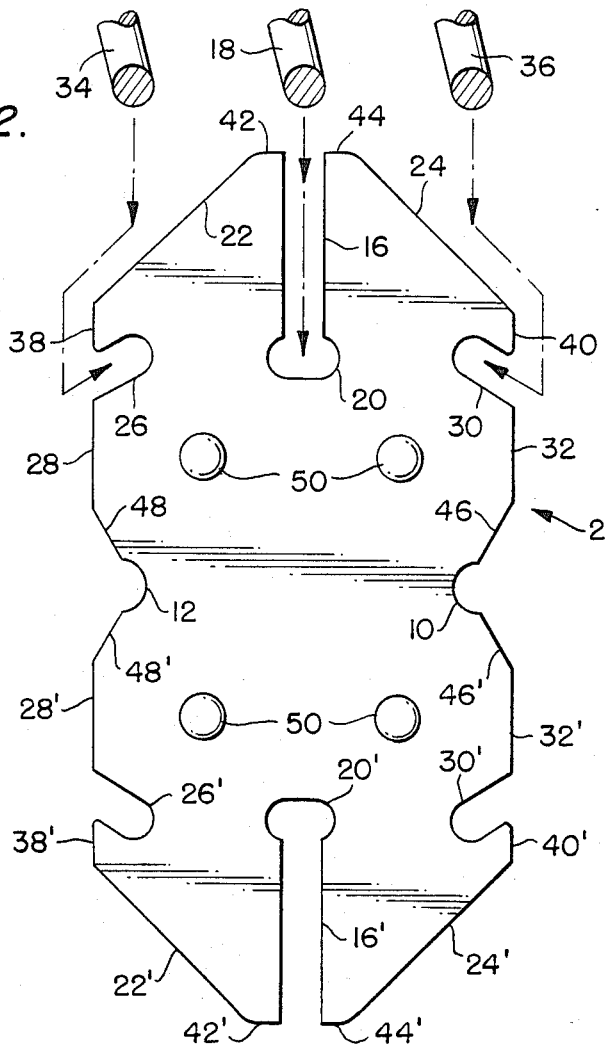
FIG. 2 is a side view of the inventive insulator illustrating the manner of installation.
Figure 3:
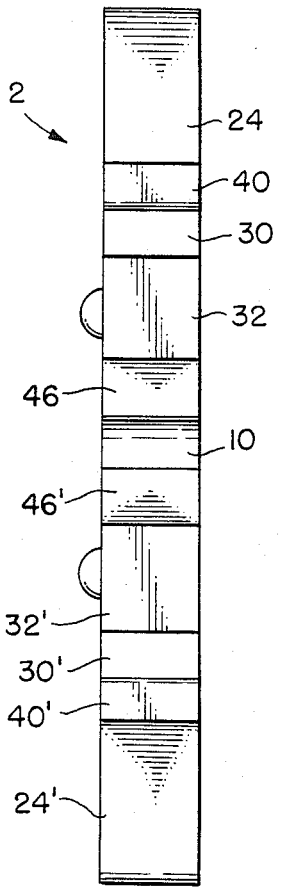
FIG. 3 is a side view of the insulator according to the invention.

The features of the inventive insulator 2 are clearly shown in FIGS. 1 and 2. One end of the insulator 2 has an elongated slot 16 therein which extends along the longitudinal axis of the insulator 2. This elongated slot receives a central convolution 18 of a set of three adjacent convolutions of the heater coil. The slot 16 terminates in a first notch 20 which has a width slightly greater than that of the slot 16. The arrows in FIG. 2 indicate the path which the central convolution 18 follows during installation of the insulator.

On opposite sides of the elongated slot 16 are guide surfaces 22 and 24. These guide surfaces are oriented at an angle to the direction of the elongated slot 16. The guide surface forms an acute angle with the slot 16, and in the preferred embodiment this angle is 42.5 degrees. The angle may, however, vary from the preferred angle and, for example, be 40 to 45 degrees.

A second notch 26 extends inwardly from one side 28 of the insulator and is below a lower end of the guide surface 22. A third notch 30 extends inwardly from an opposed side 32 and is below the lower end of guide surface 24. The second and third notches 26, 30 are adapted to receive outer convolutions 34 and 36 respectively of the heater coil and are aligned with notch 20. The heater coil is usually linear and notches 20, 26 and 30 are, thus, preferably colinear. In the preferred embodiment, the entrances to the notches 26 and 30 are spaced from the lower edges of respective guide surfaces 22 and 24 by surfaces 38 and 40, and notches 26 and 30 extend in directions oblique to that of slot 16.

Also, in the preferred embodiment, the upper ends of guide surfaces 22 and 24 are separated from the entrance to elongated slot 16 by top surfaces 42 and 44 respectively.

The insulator shown in FIGS. 1 and 2 is adapted to receive a heater coil at each end. The lower end has surfaces and notches identical to those described with respect to the upper end, and corresponding elements have been identified by corresponding, primed numbers. It should be noted that use of the insulator 2 with a single end adapted to receive a heater coil is within the concept of the invention.

An important feature of the insulator of the invention is that the distance between the upper ends of the guide surfaces 22 and 24 is smaller than the distance between outer convolutions 34 and 36 and the distance between bottoms of notches 26 and 30. This allows the central convolution 18 to be firmly placed within the elongated slot 16 before the guide surfaces 22, 24 engage outer convolutions 34, 36. It will be appreciated that it is not necessary for guide surfaces 22 and 24 to be perfectly flat, even though in the preferred embodiment these surfaces are planar. After the central convolution 18 has been engaged in slot 16, the insulator is inserted into the heater coil until the outer convolutions 34 and 36 engage respective guide surfaces 22 and 24. As the insulator is inserted into the coil, the guide surfaces 22, 24 urge outer surfaces 34 and 36 outwardly as they slide down respecitve guide surfaces 22 and 24. After the outer convolutions 34 and 36 have reached the lower ends of guide surfaces 22 and 24, they engage edge surfaces 38 and 40 and then enter the notches 26 and 30. As the outer convolutions 34, 36 enter the notches 26, 30, the resiliency of the heater coil causes them to move into the notches until each convolution engages the bottom of a respective notch. At this point, the central convolution 18 has engaged the notch 20 and the insulator is fully in place to support the heater coil. Parallel notches 10 and 12 are flanked by angled surfaces 46 and 48 to facilitate engaging the wire 8 with the notches 10 and 12.

Protuberances 50 aid in stacking the insulators after manufacture and perform no function in supporting the heater coil.

This installation procedure is very efficient and allows the installer to easily align the insulator with the three convolutions 18, 34, and 36 because of the elongated nature of the slot 16.

Modifications of the above-described structure within the scope of the appended claims will be apparent to those of skill in the art.

What is claimed is:

1. An insulator for supporting a heater coil comprising a body of electrically insulating material having one end configured to engage individual convolutions of said heater coil, said one end having a slot extending in a first direction from an upper edge of said end downwardly into said body, said slot terminating in a first notch for receiving a convolution of said heater coil, a first guide surface sloping away from said slot in a second direction which forms an acute angle with said first direction, a second notch extending inwardly from a side of said body adjacent a lower terminus of said first guide surface for receiving a second convolution of said heater coil, the distance between an upper portion of said first guide surface and said slot being less than the distance between said first and second notches, a second guide surface sloping away from said slot in a third direction which forms an acute angle with said first direction, wherein said first and second guide surfaces are on opposite sides of said slot, and a third notch extending inwardly from a location adjacent the lower terminus of said second guide surface in a second side of said body for receiving a third convolution of said heater coil, the inner ends of said first, second, and third notches being substantially colinear and wherein the distance between an upper protion of said second guide surface and said slot is less than the distance between said first and third notches.

2. The insulator of claim 1 wherein said second and third notches extend in respective directions oblique to said first direction.

3. The insulator of claim 1 further comprising a first flat surface perpendicular to said first direction between the upper terminus of said first guide surface and the upper terminus of said slot and a second flat surface perpendicular to said first direction between said upper terminus of said slot and the upper terminus of said second guide surface.

4. The insulator of claim 3 further comprising a third flat surface substantially parallel to said first direction and extending from the lower terminus of said first guide surface to said second notch, and a fourth flat surface parallel to said first direction and extending from the lower terminus of said second guide surface to said third notch.

5. The insulator of claim 4 further comprising means for receiving means for grasping said body to support said body and said heater coil.

6. The insulator of claim 4 further comprising a second end configured to engage individual convolutions of a heater coil and having a second slot extending from said second end in a direction opposite to said first direction and terminating in a fourth notch, and third and fourth guide surfaces extending from locations adjacent the outer terminus of said second slot to locations adjacent respective fifth and sixth notches.

7. The insulator of claim 4 wherein each of said first and second guide surfaces is planar.

* * * * *